United States Patent [19]

Connell

[11] 4,387,674

[45] Jun. 14, 1983

[54] VALVE TRAIN

[76] Inventor: Calvin C. Connell, 1618 Twelve Oaks Way, North Palm Beach, Fla. 33408

[21] Appl. No.: 267,745

[22] Filed: May 28, 1981

[51] Int. Cl.[3] ..... F01L 1/14; F01L 1/24

[52] U.S. Cl. ..... 123/90.16; 123/90.48

[58] Field of Search ..... 123/90.16, 90.15, 90.48

[56] References Cited

U.S. PATENT DOCUMENTS 2,266,077 12/1941 Roan ..... 123/90.16
3,382,854 5/1968 Steiner ..... 123/90.16
4,223,648 9/1980 Pozniak et al. ..... 123/90.16
4,337,739 7/1982 Jordan ..... 123/90.16

*Primary Examiner*—William A. Cuchlinski, Jr.
*Attorney, Agent, or Firm*—Harness, Dickey & Pierce

[57] ABSTRACT

A valve train for an internal combustion engine that permits adjustment during running of the valve events. This is achieved by a follower having a pair of follower surfaces which may be moved while the engine is running to control both the point of opening and independently the point of closing of each valve.

4 Claims, 6 Drawing Figures

FIG. 2.
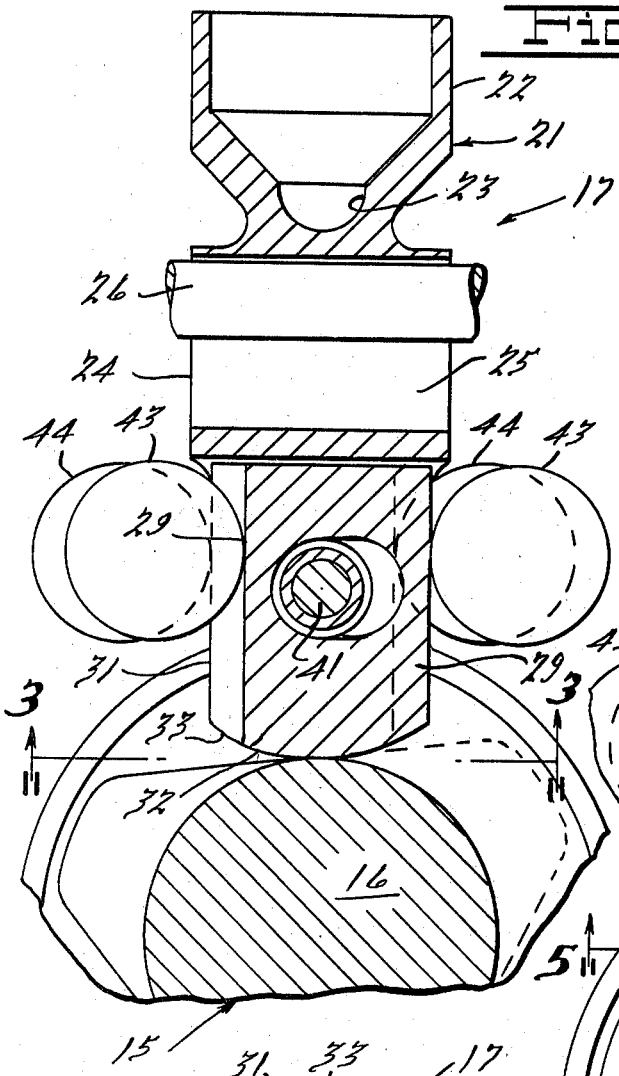
FIG. 4.
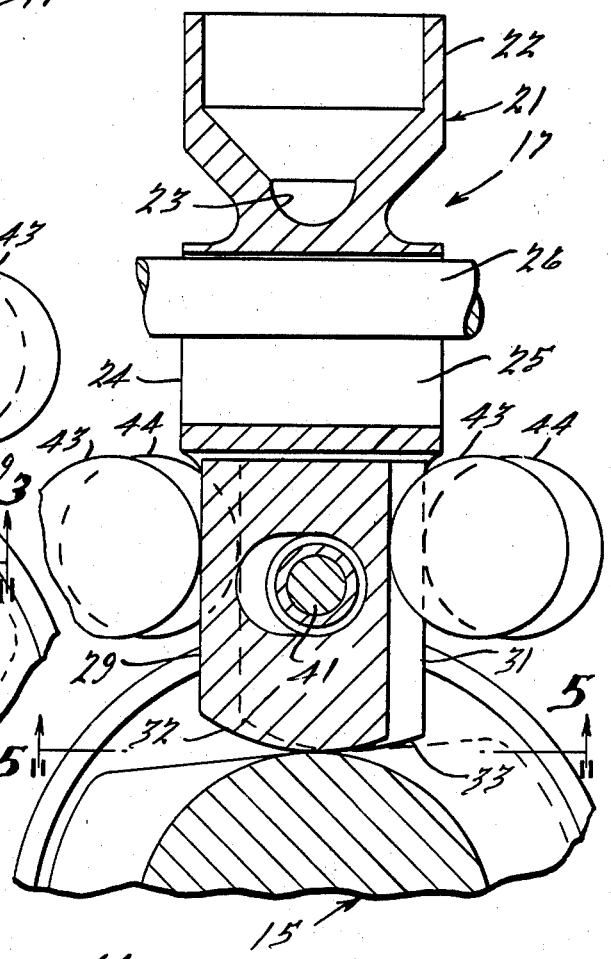
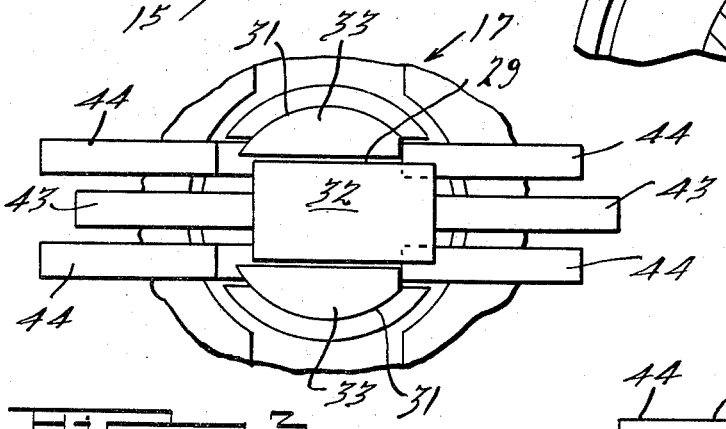
FIG. 3.
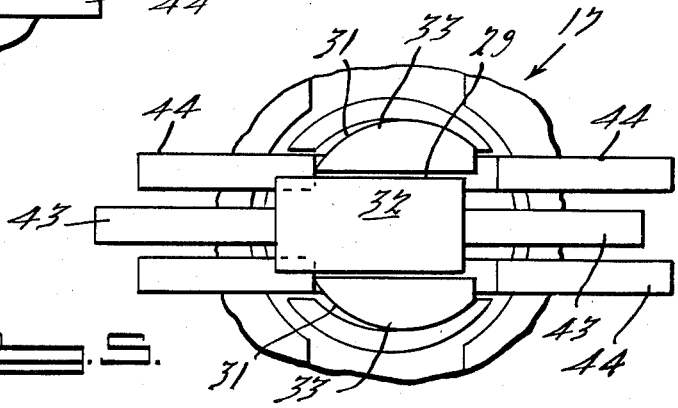
FIG. 5.

VALVE TRAIN

BACKGROUND OF THE INVENTION

This invention relates to a valve train for an internal combustion engine and more particularly to a valve train that permits adjustment of both the valve events and the valve duration.

As is well known, many features in conjunction with the design of internal combustion engines, and particularly those for automotive vehicles, are dictated by compromises in running characteristics. The design of the valve train, and specifically the valve timing, is one of the best known of these design compromises. In order to provide adequate breathing at high engine speeds, it is desirable to provide both a long duration of the valve opening and a substantial degree of overlap. That is, in order to assure good and consistent gas flow at high speeds, it has been the practice to provide a considerable overlap between the opening of the intake valve and the closing of the exhaust valve. Such overlap is necessary to permit the induction of a full charge and to insure good scavenging of the chamber at the completion of each power stroke. On the other hand, such long duration valve opening and considerable overlap significantly reduces performance at low speeds and can increase undesirably the exhaust gas emissions. At low speeds the greater duration and longer overlap has a tendency to cause exhaust gases to backflow into the intake system and thus reduce charging efficiency. This results in the characteristic of most engines employing radical valve timing and of having extremely rough idle operation and/or the necessity for employing high idle speeds.

From the aforenoted description it should be readily apparent that engines embodying fixed valve timing must employ a compromised timing arrangement. The degree of compromise depends upon which running characteristic and engine operating speed at which the design is to be optimized.

Various arrangements have been proposed to permit variations in valve timing during engine running. In this way the valve timing may be altered to suit the specific running condition and offer improved performance and emission control over wider engine speed ranges. The variable valve timing arrangements previously known have, however, only afforded the opportunity to either advance or retard the timing events or either one set of valves (intake or exhaust) or all valves if they are all operated by the same camshaft. In essence, most of these devices have actually altered the angular relationshp between the camshaft and the crankshaft. The inventor is unaware of any arrangement that has permitted individual adjustment between the intake and exhaust valve timing when all valves are driven by a single fixed camshaft. Also, the inventor is unaware of any arrangement which permits changing of the duration of opening of the valves of an internal combustion engine through operation of the cam follower.

It is, therefore, a principal object of this invention to provide an arrangement wherein the valve timing and also valve duration may be modified during running of the engine.

It is also an object of this invention to provide an arrangement wherein the timing of the intake and exhaust valves may be controlled independently even though both valves are operated by a single camshaft.

It is a further object of this invention to provide a valve train for an internal combustion engine in which all events and valves may be adjusted during running of the engine.

SUMMARY OF THE INVENTION

This invention is adapted to be embodied in a valve train for an internal combustion engine that comprises a poppet valve supported for movement between an opened position and a closed position, a output shaft and valve actuating means for controlling the opening and closing movement of the poppet valve in response to changes in the angular position of the output shaft. In accordance with the invention, means are provided for varying the duration of opening of the poppet valve in relation to the output shaft angle during running of the engine.

Another feature of this invention is also adapted to be embodied in a valve train for an internal combustion engine. The valve train includes an intake valve, an exhaust valve, and a single camshaft for operating both of the valves, actuating means is interposed between a camshaft and each of the intake and exhaust valves, the actuating means, in accordance with this feature of the invention, incorporates means for adjusting the timing of the opening of the intake and exhaust valves independently of each other.

BRIEF DESCRIPTION OF THE DRAWINGS

FIG. 2 is an enlarged cross-sectional view showing the cam lobe and tappet arrangement associated with one of the valves of the engine.

FIG. 3 is a view taken generally in the direction of line 3—3 of FIG. 2.

FIG. 4 is an enlarged view, in part similar to FIG. 2, showing the valve actuating mechanism in another of its adjusted positions.

FIG. 5 is a cross-sectional view taken along the line 5—5 of FIG. 4, and is in part similar to FIG. 3.

DETAILED DESCRIPTION OF THE PREFERRED EMBODIMENT

Figure 1:
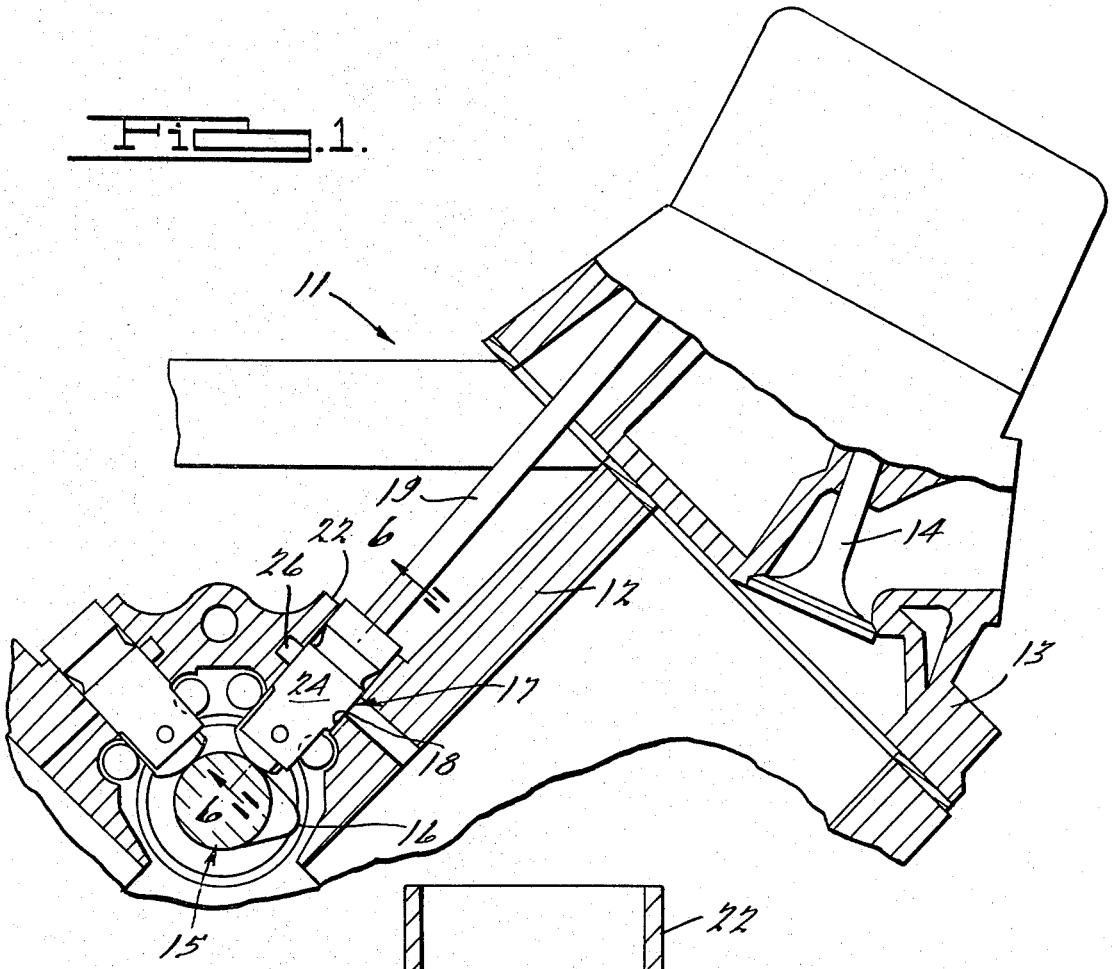
FIG. 1 is an end elevational view of a portion of an internal combustion engine, with portions shown in section, embodying this invention.
Figure 6:
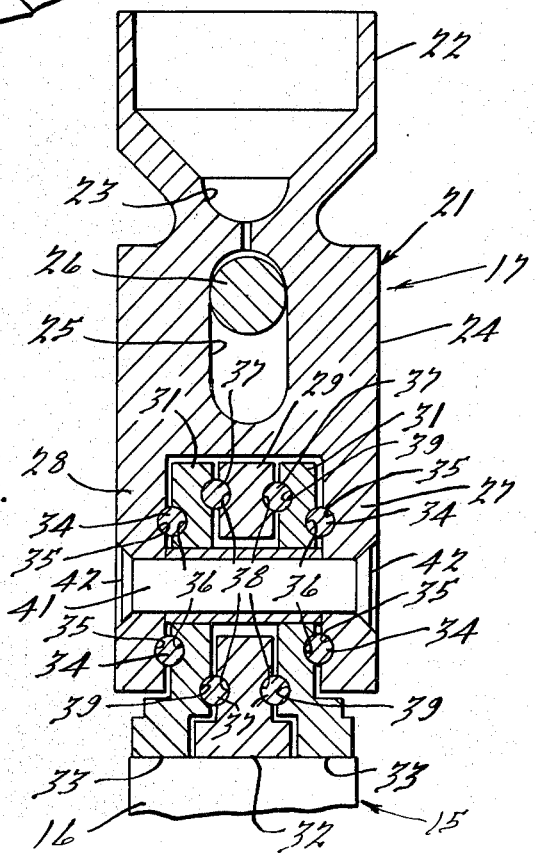
FIG. 6 is a cross-sectional view taken along the line 6—6 of FIG. 1.

Referring first to FIG. 1, the invention is illustrated as being embodied in the valve train of a V-type overhead valve engine, indicated generally by the reference numeral 11. It is to be understood that the invention is capable of use in other engine formations and in engines having overhead camshafts, such camshafts having cam followers or rocker cam followers; side valves; or other such configurations. Such variations are believed to be within the scope of those skilled in the art.

The engine 11 includes a cylinder block 12 to which a pair of cylinder heads (only one of which is shown in the drawings) 13 are affixed. Intake and exhaust valves 14 are suitably supported in the cylinder head 13 and, in the illustrated embodiment, are operated by rocker arms (not shown). A camshaft, indicated generally by the reference numeral 15, is provided for actuating the valves 14 and for this purpose is formed with lobes 16. Tappets constructed in accordance with this invention are indicated generally by the reference numeral 17 and are slideably supported in bores 18 in the cylinder block 12 adjacent to the camshaft 15 and cooperate with the lobes 16. Push rods 19 transmit motion from the tappets 17 to the rocker arms and thence to the valve 14 in a known manner.

The tappets 17 and the arrangement which cooperates with them is such that they permit adjustment during running of the engine of the complete valve events. That is, the tappets 17 and their associated actuating mechanism permits the point of opening and, or, the point of closing of the valves 14 to both be adjusted and those of the exhaust valves to be adjusted independently of the intake valve. In this way, the valve duration may also be varied during engine running. The way that this is done will now be described by reference to the remaining figures as well as to FIG. 1. The tappets 17 each include a body portion, indicated generally at 21, which has a generally hour-glass configuration with an upper cylinder portion 22 which defines a socket 23 for receiving the lower end of each push rod 19.

A lower cylinder portion 24 is formed with a transversely extending elongated aperture 25 that slideably surrounds a pin 26 that is affixed to the cylinder block 12 and which cooperates with the tappet 17 so as to hold the tappet against rotation.

A pair of spaced arms 27 and 28 depend from the cylindrical portion 24. The arms 27 and 28 define a gap in which an inner cam follower 29 and a pair of outer cam followers 31 are supported. The inner follower 29 has a surface 32 which is engaged with the cam lobe 16. In a like manner the outer followers 31 have follower surfaces 33 which are also engaged with the cam lobe 16 on axially opposite sides of the surface 32. The cam lobe 16 has sufficient axial length so that all of the surfaces 32 and 33 will be engaged with it.

Pairs of guide pins 34 are received in recesses 35 in the legs 27 and 28 and in recesses 36 in the adjacent faces of the followers 31. The pins 34 serve to transmit radial forces from the cam lobe 16 to the body of the tappet 17 while at the same time permitting the followers 31 to move transversely relative to the legs 27 and 28, as will become apparent.

The follower 29 is suspended in a similar manner to and by the followers 31 by means of pairs of pins 37 which are received in recesses 38 formed in the follower 29 and recesses 39 formed in the followers 31. The pins 37 transmit motion in the opening and closing direction from the follower 29 to the followers 31 and thence to the tappet body 21 while at the same time permitting transverse movement. A pin 41 extends through the legs 27 and 28 and through elongated openings in the followers 29 and 31. The pin 41 has heads 42 that resist any tendency for the legs 27 and 28 to spread as a result of the forces transmitted from the cam lobe 16 to the tappet body 21 through the pins 34 and 37.

The transverse position of the follower 29 is controlled by a pair of eccentric actuators 43 (FIGS. 2 through 5) that are engaged with opposite sides of the follower 29. By rotating the actuators 43, the follower 29 may be moved between a fully advanced position (as shown in FIGS. 2 and 3) and a fully retarded position (as shown in FIGS. 4 and 5). The actuators 43 are controlled in any manner either automatically in response to engine speed or any other variables or combination thereof. If desired, manual control may be provided. In a like manner, the followers 31 may be moved transversely by pairs of actuators 44 which are also eccentric and which engage opposite sides of the followers 31. The followers 31 may be moved by rotation of the actuators 44 between a fully retarded position as shown in FIGS. 2 and 3, and a fully advanced position as shown in FIGS. 4 and 5. This control may also be accomplished either manually or automatically. In addition, the follower 29 may be positioned independently of the position of the followers 31. It should be readily apparent from an inspection of FIGS. 2 and 4 that movement of the followers 29 and 31 in a transverse direction will permit adjustment of the both and the point at which the tappet 17 begins to open the valve 14 through appropriate advancing or movement of the followers to the right, as viewed in these figures, as well as controlling the point of closing by controlling the degree of movement of the followers to the left as viewed in these figures. That is, the point of opening of each valve may be controlled independently of both duration and the timing of the valve closing. Thus, the engine 11 can be run under optimum conditions at all speeds and load ranges.

It is to be understood that as has already been noted, the foregoing description is that of a preferred embodiment of the invention. Various changes and modifications may be made without departing from the spirit and scope of the invention as defined by the appended claims.

I claim:

1. In an internal combustion engine comprising a poppet valve supported for movement between an opened position and a closed position, an output shaft and valve actuating means including a cam and follower for controlling the opening and closing movement of said poppet valve in response to changes in the angular position of said output shaft, the improvement comprising means for varying the duration of the opening of said poppet valve in relation to output shaft rotation during the running of the engine comprising a member carried by said follower and movable therewith along a fixed path of movement as said follower moves to open and close said valve, and means for adjusting said member relative to said follower to adjust said valve duration without altering the path of movement of said member upon the opening and closing of said valve.

2. A valve train as set forth in claim 1 wherein the means for varying the duration of the poppet valve comprises means for adjusting the point at which the valve opens without simultaneously effecting the angular position of the output shaft at which the valve closes.

3. A valve train as set forth in claim 2 wherein the means for varying the valve duration is effective to change the point of valve opening and the point of valve closing each independently of each other.

4. In an internal combustion engine comprising a poppet valve supported for movement between an opened position and a closed position, an output shaft and valve actuating means including a cam and follower for controlling the opening and closing movement of said poppet valve in response to changes in the angular position of said output shaft, the improvement comprising means for varying the duration of the opening of said poppet valve in relation to output shaft rotation during the running of the engine including means for changing the contact area between the cam and cam follower and the transverse relationship between the cam and follower surface comprising a pair of follower surfaces carried by said follower and adapted to engage a cam lobe and the varying means includes means for adjusting the follower surface transversely of the follower.

* * * * *